US009659551B1

(12) United States Patent
Rubin

(10) Patent No.: US 9,659,551 B1
(45) Date of Patent: May 23, 2017

(54) END BLOWN WOODWIND HARNESS

(71) Applicant: Lauren Rubin, Pacific Palisades, CA (US)

(72) Inventor: Lauren Rubin, Pacific Palisades, CA (US)

( * ) Notice: Subject to any disclaimer, the term of this patent is extended or adjusted under 35 U.S.C. 154(b) by 0 days.

(21) Appl. No.: 15/004,070

(22) Filed: Jan. 22, 2016

(51) Int. Cl.
*G10G 5/00* (2006.01)

(52) U.S. Cl.
CPC ..... *G10G 5/005* (2013.01)

(58) Field of Classification Search
CPC ..... G10D 9/00; G10D 9/043; G10D 13/026; G10G 5/00; G10G 7/005; F16M 11/041; F16M 13/00
USPC ..... 84/385 A, 387 A, 380 R
See application file for complete search history.

(56) References Cited

U.S. PATENT DOCUMENTS

| | | | | |
|---|---|---|---|---|
| 2,247,867 | A | 2/1938 | Baumann | |
| 5,873,503 | A | 2/1999 | Atherton et al. | |
| 2003/0192423 | A1* | 10/2003 | Crouch | G10G 5/005 84/421 |
| 2005/0145094 | A1* | 7/2005 | Shumake | G10G 5/005 84/453 |

OTHER PUBLICATIONS http://www.guitarcenter.com/JAZZLAB/saXholder-Saxophone-Harness-1359388230745.gc Jazzlab saXholder.

* cited by examiner

*Primary Examiner* — Kimberly Lockett
(74) *Attorney, Agent, or Firm* — Kenneth Altshuler

(57) ABSTRACT

A woodwind harness that provides support a woodwind musical instrument to relieve fatigue from a musician's arms and shoulders is described. The woodwind harness generally comprises a sternum plate adapted to press against a human sternum with a pair of rigid members extending from the sternum plate and terminating in a hook shaped bend that is arranged and configured to hook over a human shoulder. Between the sternum plate and the hook shaped bend is an elastic cord attached to each of the rigid members. An end-blown woodwind instrument is attached to the elastic cord by way of an attaching means.

19 Claims, 8 Drawing Sheets

END BLOWN WOODWIND HARNESS

CROSS-REFERENCE TO RELATED APPLICATIONS

None.

FIELD OF THE INVENTION

The present embodiments are directed to a harness apparatus that supports an end blown woodwind instrument.

DESCRIPTION OF RELATED ART

For hundreds of years musicians 102 have typically held an end-blown instrument 100 with two hands, up to their mouths 104 in front of their bodies, arms bent to both support their instrument 100 while playing the keys 110 as depicted in FIG. 1. Depending on how long a musician 102 is playing, the musician 102 can experience fatigue from holding their arms 112 in the position as shown. In the present example, the end blown instrument 100 is a clarinet. The clarinet 100 is played by blowing through a mouthpiece 108 whereby various notes are achieved by manipulating the keys 110. The notes are directed through the bell-shaped end 106.

It is to innovations related to this subject matter that the claimed invention is generally directed.

SUMMARY OF THE INVENTION

The present embodiments generally relate to an apparatus for supporting an end-blown instrument that advantageously provides some relief from muscle fatigue (for a musician) from holding the woodwind instrument while playing the musical instrument for prolonged periods of time.

Some embodiments of the present invention contemplate an end-blown woodwind harness generally comprising a sternum plate adapted to contact a human sternum; a first and second rigid member extending from the sternum plate each terminating in a hook shaped bend, each of the hook shaped bends adapted to hook over a human shoulder; an elastic cord having a first and a second cord end, the first cord end attached to the first rigid member between the hook shaped end and the sternum plate, the second cord end attached to the second rigid member between the hook shaped end and the sternum plate; and a means for attaching an end-blown woodwind instrument to the elastic cord.

Other embodiments of the present invention contemplate an end-blown woodwind harness comprising: a first and second elongated arm extending from a center location at a first end, each of the elongated arms possessing a hook shaped bend at a second end, each of the hook shaped bends adapted to hook over a human shoulder; an elastic cord having a first and a second cord end, each of the cord ends attached to one of the elongated arms between the center location and the hook shaped bends; and a means for attaching an end-blown woodwind instrument to the elastic cord.

DETAILED DESCRIPTION

Initially, this disclosure is by way of example only, not by limitation. Thus, although the instrumentalities described herein are for the convenience of explanation, shown and described with respect to exemplary embodiments, it will be appreciated that the principles herein may be applied equally in other types of musical instruments of less than or equal to the size of a standard oboe, such as a standard clarinet, a recorder, shakuhachi flute, etc., for example. In what follows, similar or identical structures may be identified using identical callouts.

Figure 1:
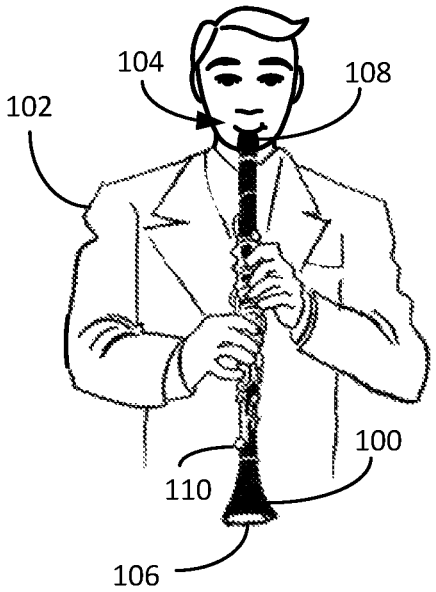
PRIOR ART FIG. 1
FIG. 1 depicts a prior art image of a clarinetist playing a clarinet.
Figure 2A:
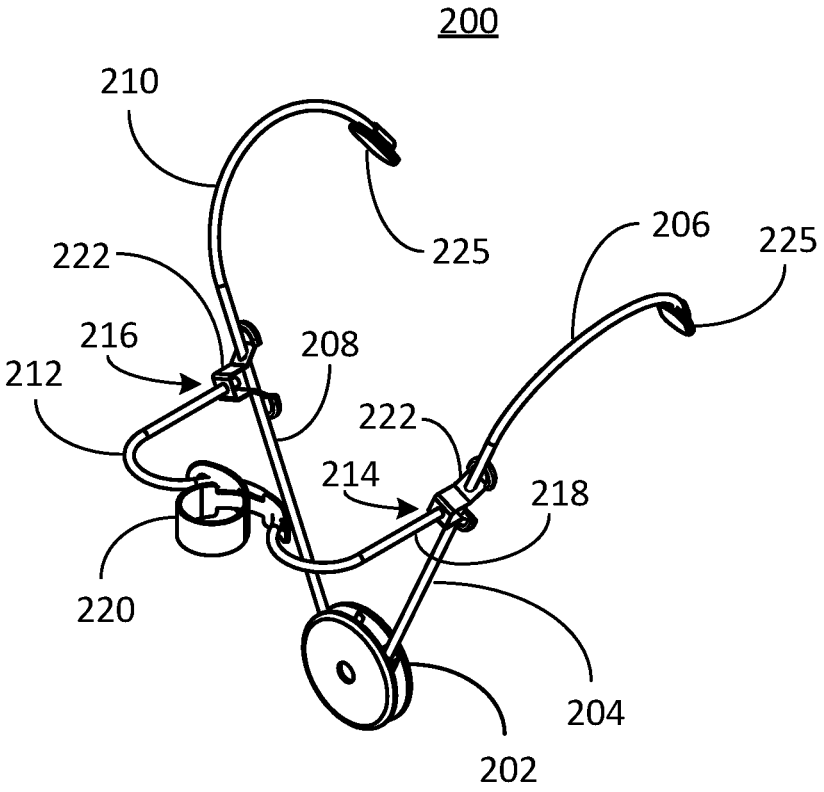
FIG. 2A illustratively depict perspective view of an embodiment of a woodwind harness constructed in accordance with various embodiments of the present invention.

FIG. 2A illustratively depict perspective view of an embodiment of a woodwind harness 200 constructed in accordance with various embodiments of the present invention. As shown, the woodwind harness 200 possesses a sternum plate 202 that is adapted to rest in contact on a human sternum (not shown). A first elongated rigid member 204, also considered an elongated arm, extends from the sternum plate 202 and terminates in a left shoulder hook shaped bend 206 that is adapted to hook over the left player's shoulder. A second elongated rigid member 208 extends from the sternum plate 202 at an angle offset from the first elongated rigid member 204. The second elongated rigid member 204 terminates at a right shoulder hook shaped bend 210 that is adapted to hook over the right player's shoulder. Certain embodiments contemplate the woodwind harness 200 consisting of only the first elongated rigid member 204 and the second elongated rigid member 208 extending from the sternum plate 202. Certain embodiments contemplate the angle offset between the first elongated rigid member 204 and the second elongated rigid member 208 being adjustable. Other embodiments contemplate the length of the first elongated rigid member 204 and the second elongated rigid member 208 being adjustable. While other embodiments contemplate the right shoulder hook shaped bend 210 and the left shoulder hook shaped bend 206 being adjustable to fit different sized shoulders. Adjustability can be accomplished with this shoulder hook shaped bend being made of a pliable material that is semi rigid to adjust the curvature of the bend or, optionally, a structure that can lengthen and shorten, for example a telescoping configuration known to those skilled in the art.

Figure 2B:
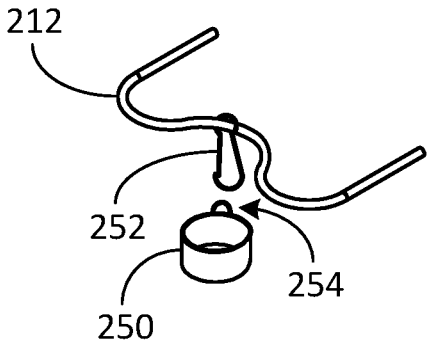
FIG. 2B illustratively depicts an embodiment of a latching mechanism to attach an end-blown woodwind to the elastic cord constructed in accordance with various embodiments of the present invention.

With continued reference to the harness 200, an elastic cord 212 is attached to the first elongated rigid member 204 between the sternum plate 202 and the left shoulder hook shaped bend 206 at a first cord end 214. The elastic cord 212 is also attached to the second elongated rigid member 208 between the sternum plate 202 and the right shoulder hook shaped bend 210 at a second cord end 216. The elastic cord 212 provides an important benefit of allowing a musician an extra degree of freedom of moving the attached musical instrument away from the harness 200 beyond the non-stretched length of the elastic cord 212. Embodiments of the elastic cord 212 contemplate being constructed from a bungee cord, a rubber band, rubber tubing and the like. Certain embodiments contemplate the length of the elastic cord 212 being adjustable. Other embodiments contemplate the elastic cord 212 possessing rigid portions 218 that terminate to the elongated rigid members 208 and 204. The present embodiment depicts a cuff 220 connected to the elastic cord 212. The cuff 220 is adapted to conform to the outer circumference of the woodwind to attach the woodwind to the elastic cord 212. Certain embodiments contemplate the cuff 220 being made of rubber or some other flexible material that can constrict around the musical instrument's circumference to stay fixed in one location, i.e., unable to slide up and down musical instrument. An optional embodiment for attaching a woodwind to the elastic cord 212 is envisioned to be a clip 252 that can easily be removably attached to a collar 250 providing a loop 254, or some other retaining fixed year with a loop 254, as illustratively shown in FIG. 2B. Certain other embodiments contemplate the end-blown instrument 100 (such as an oboe or clarinet) providing a ring (not shown) integrated with the instrument 100 to which the clip 252 can readily attached.

With continued reference to FIG. 2A, optional embodiments contemplate a pair of cord retaining fixtures 222 that adjustably fix the elastic cord 212 along the length of the elongated rigid members 208 and 204 between the sternum plate 202 and the hook shaped bends 210 and 206. Certain embodiments contemplate cord retaining fixtures that are not adjustable. The present embodiment also optionally depicts a pair of shoulder pads 225 that rest on the musician's upper back (see FIG. 7).

Embodiments of the harness advantageously support a woodwind musical instrument smaller than or equal to the size of a standard oboe to provide some shared load distribution to a musician's arms and shoulders improving fatigue experienced by the musician. Embodiments of the harness are devoid of straps that wrap around a musician's back and sides. Also advantageously, embodiments of the harness are devoid of additional elements extending from the sternum plate 202 or the center bend 602 that contact with other parts of the musician's body, such as belly or pubic area.

Figure 3:
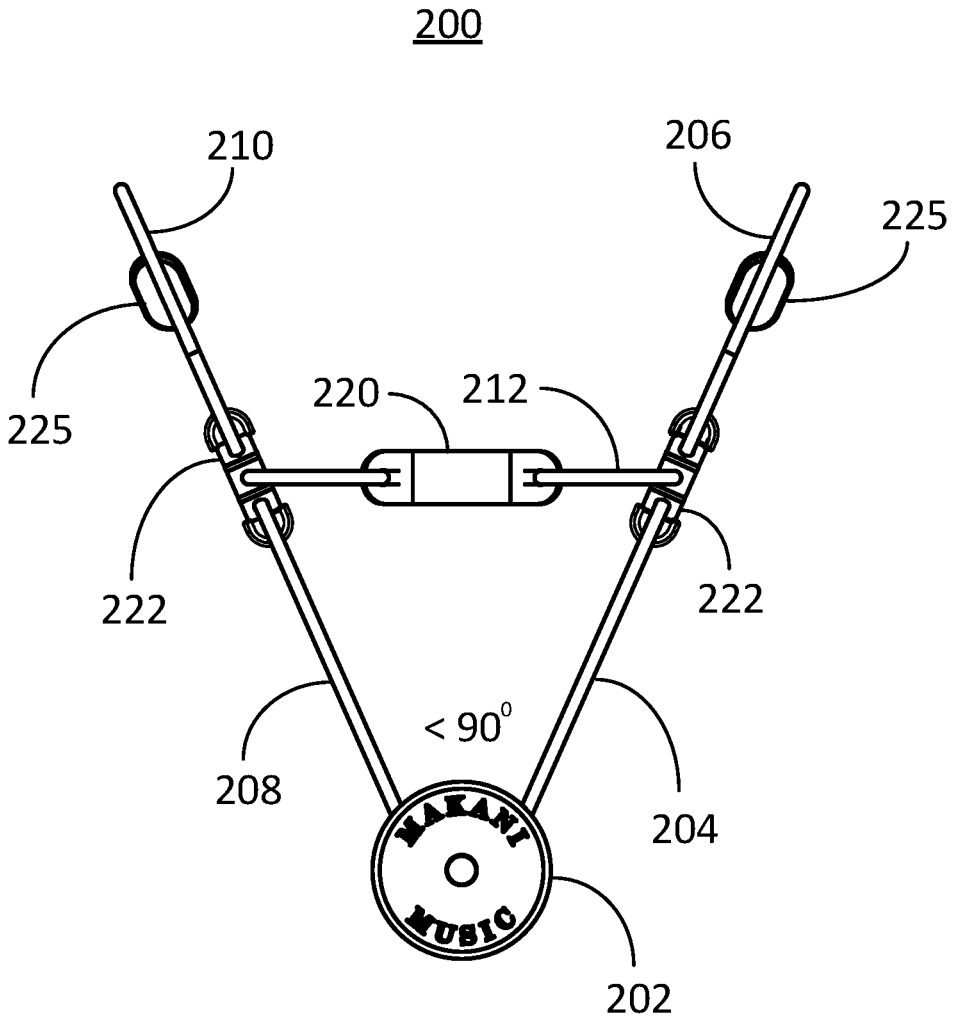
FIG. 3 illustratively depicts a front view of an embodiment of a woodwind harness constructed in accordance with certain embodiments of the present invention.

FIG. 3 illustratively depicts a front view of the woodwind harness embodiment 200 consistent with FIG. 2. In the present embodiment, the elongated rigid members 208 and 204 extend in a straight line from the sternum plate 202, however alternative embodiments contemplate the elongated ridged members 208 and 204 having curvature and optionally varied widths. Certain embodiments further envision the angle between the first elongated rigid member 204 and the second elongated rigid member 208 being less than 90°, as shown. While other embodiments envision do not have a restriction on the angle between the first elongated rigid member 204 and the second elongated rigid member 208. As previously mentioned, certain embodiments contemplate the angle between the first elongated rigid member 204 and the second elongated rigid member 208 being adjustable to accommodate varied widths of different musicians' shoulders.

Figure 4:
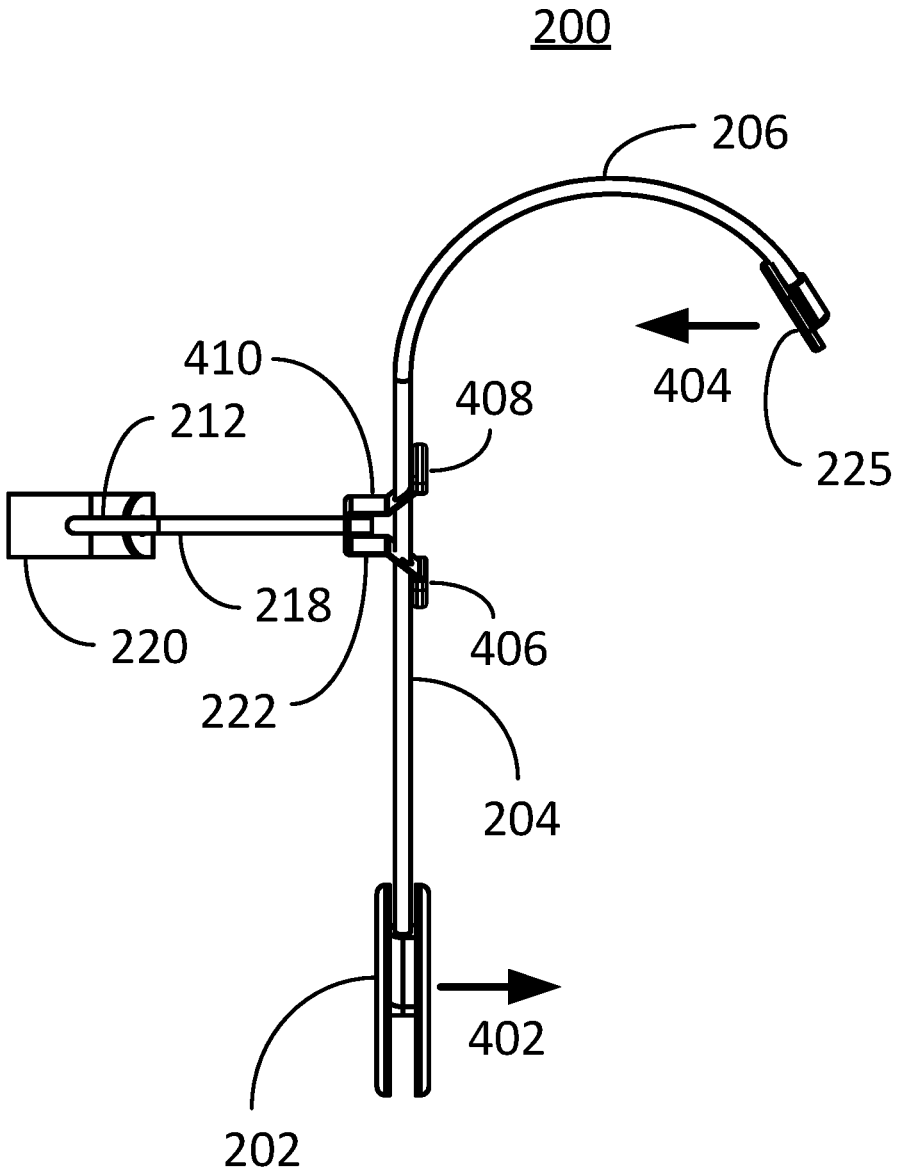
FIG. 4 illustratively depicts a side view of an embodiment of a woodwind harness constructed in accordance with certain embodiments of the present invention.

FIG. 4 illustratively depicts a side view of the woodwind harness embodiment 200 consistent with FIG. 2. As shown here, the cord retaining fixture 222 possesses two rubber ends 408 and 406 attached to a spring member 410 to retain the cord 218 in a set position along the length of the elongated rigid member 204. When the rubber ends 408 and 406 are squeezed together the elastic cord 212 can be adjusted to go up and down the length of the elongated rigid member 204. While the woodwind harness 200 is worn by a musician, the sternum plate 202 presses against the chest of the musician as indicated by arrow 402 and the shoulder pad 225 at the terminal end of the left shoulder hook shaped bend 206 presses against the upper back/shoulder of the musician as indicated by arrow 404.

Figure 5:
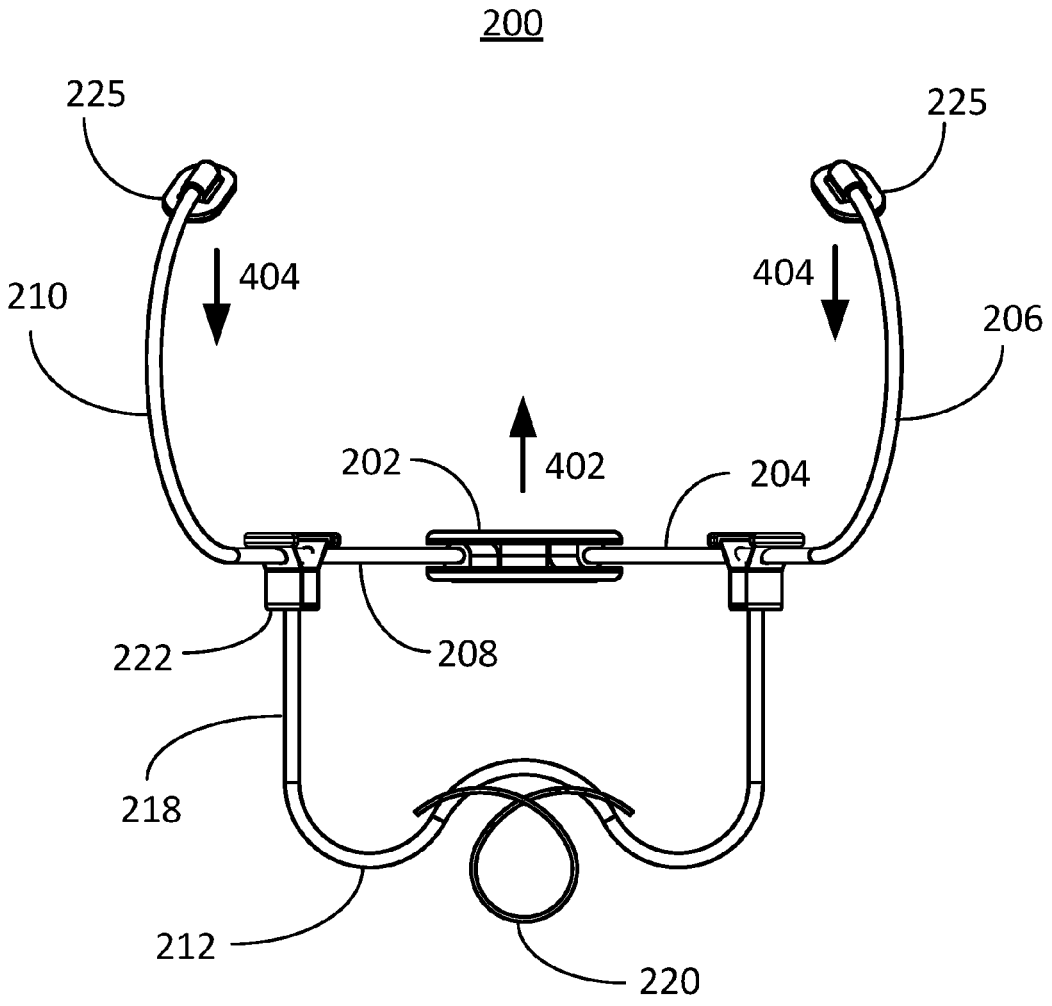
FIG. 5 illustratively depicts a top view of an embodiment of a woodwind harness constructed in accordance with certain embodiments of the present invention.

FIG. 5 illustratively depicts a top view of the woodwind harness embodiment 200 consistent with FIG. 2. As shown here, the left shoulder hook shaped bend 206 and the right shoulder hook shaped bend 210 are sized to accommodate looking over a musician's shoulder. When worn by the musician, the shoulder pads 225 press against the upper back/shoulder of the musician as indicated by arrow 404 and the sternum plate 202 presses against the chest (sternum) of the musician. The end-blown woodwind instrument (not shown) is retained by the cuff 220 that wraps around the circumference of the end-blown woodwind instrument.

Figure 6A:
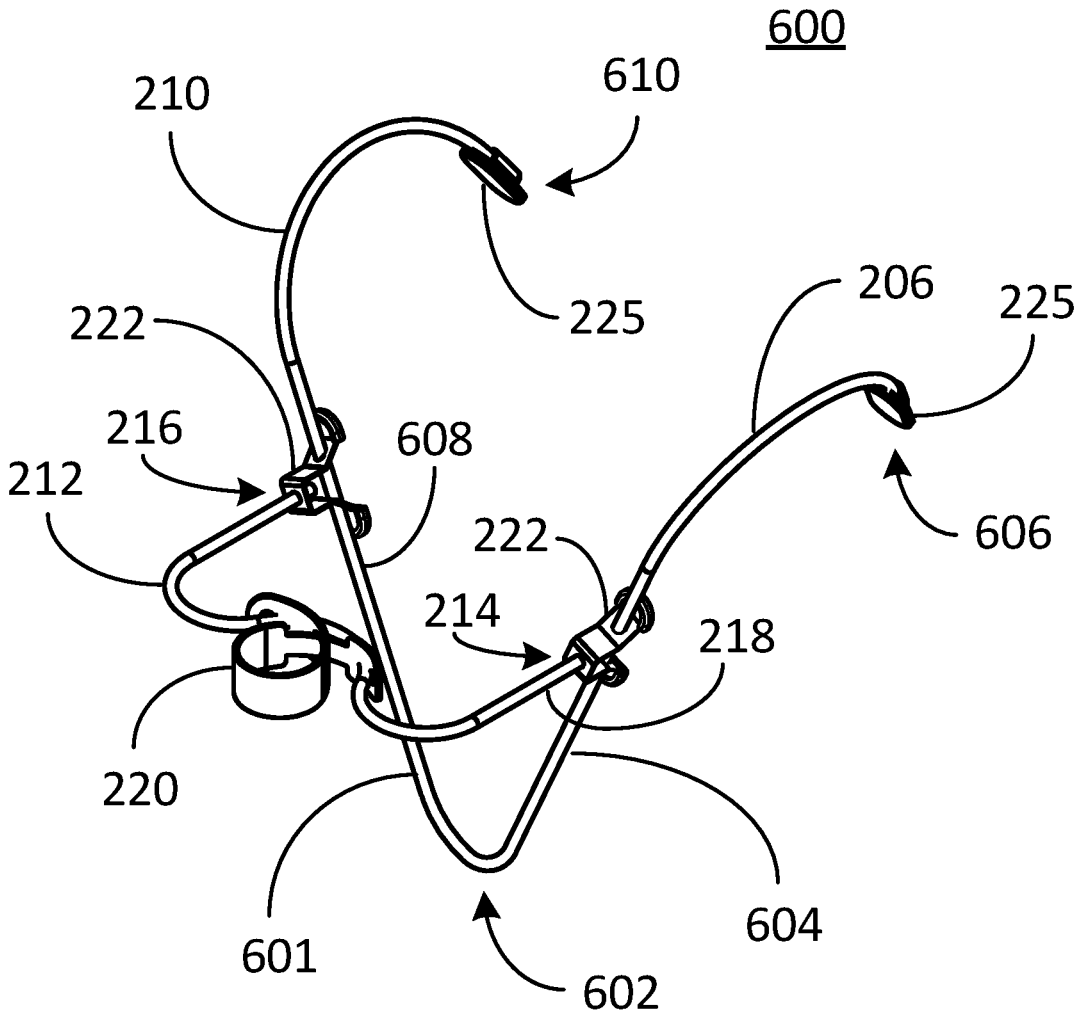
FIGS. 6A and 6B illustratively depict an optional embodiment of a woodwind harness constructed in accordance with certain embodiments of the present invention.
Figure 6B:
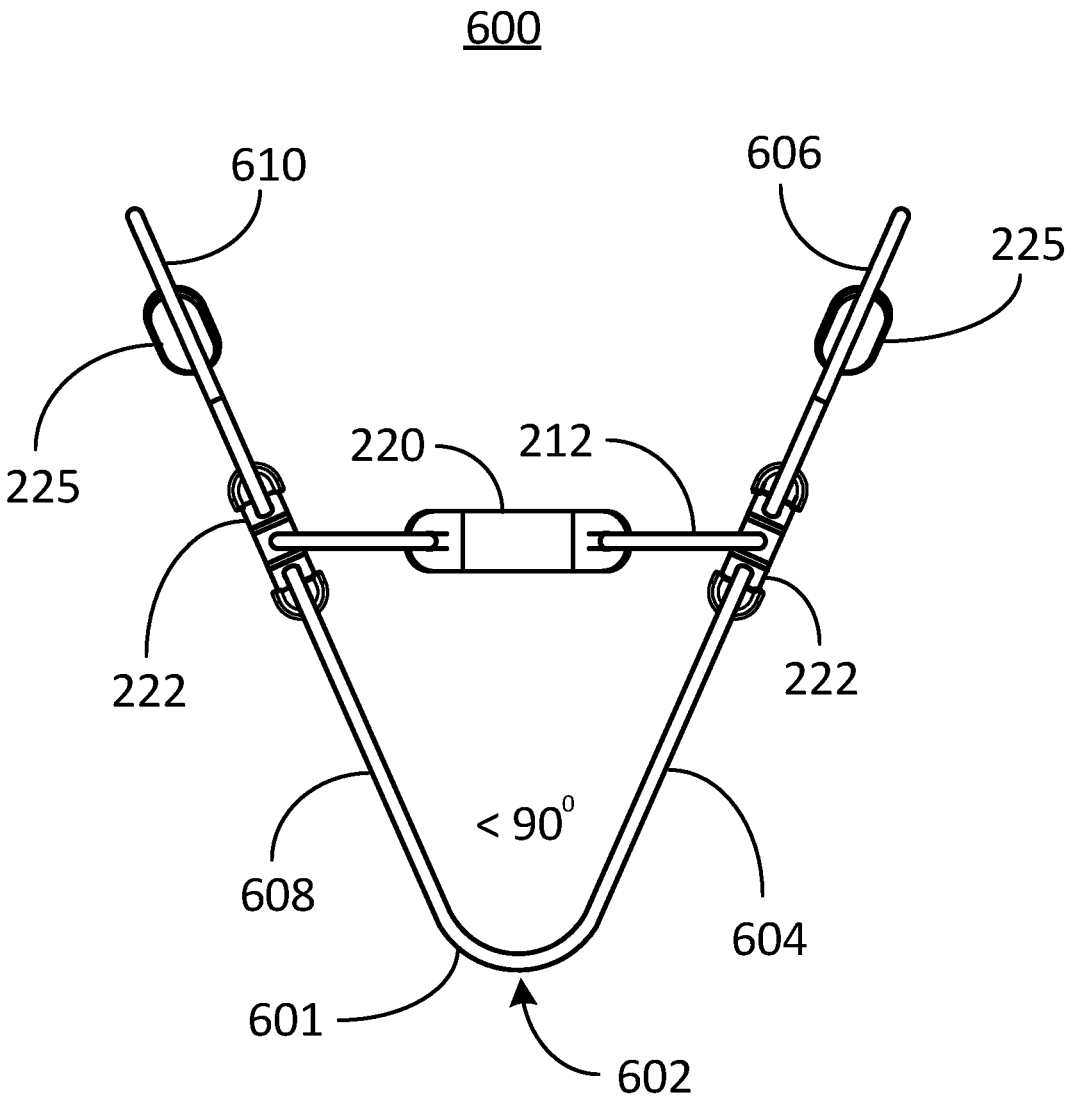

FIGS. 6A and 6B illustratively depict an alternative embodiment of a woodwind harness 600 in accordance with embodiments of the present invention. FIG. 6A is a perspective drawing and FIG. 6B is a front view drawing of the woodwind harness 600. As shown, there is one elongated member 601 with a center bend 602 at essentially the midpoint between a first end 606 and the second and 610 of the elongated member 601. There is a first hook shaped bend 206 and the second hook shaped bend 210 that are adapted to hook over a human shoulder (not shown). The center bend 602 is adapted to press against a human chest. In this embodiment, there is no need for any other members or elements extending from the center bend 602 beyond the left side of the elongated member 604 and the right side of the elongated member 608 (the left side and right side are coordinated with respect to the musician that wears the woodwind harness 600). As with the embodiment of FIG. 2A, the shoulder pads 225 press against the musician's upper back/shoulders and the center bend presses against the musician's chest essentially at the sternum.

Figure 7:
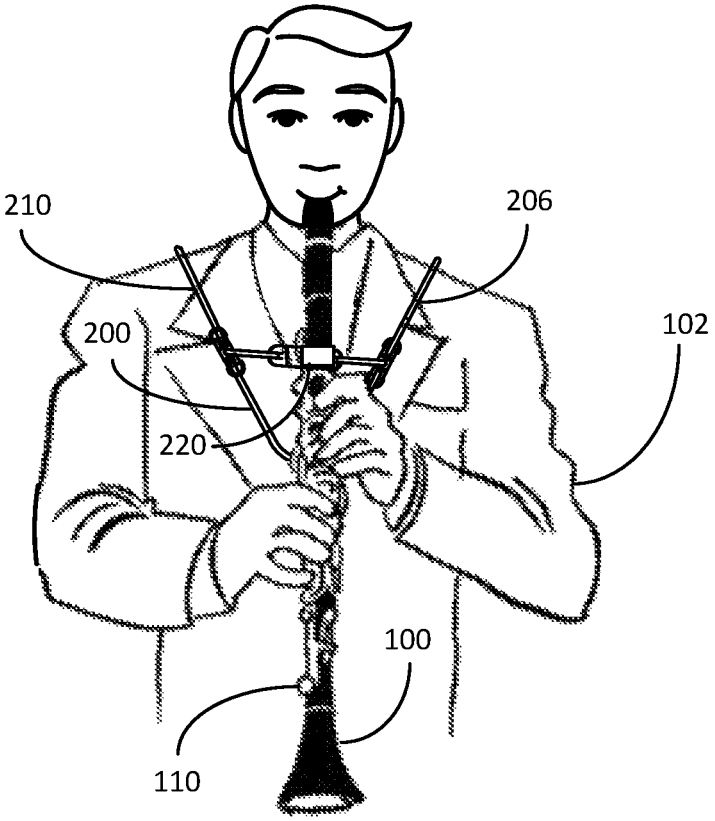
FIG. 7 illustratively depicts a musician holding a clarinet while wearing a harness constructed in accordance with certain embodiments of the present invention.

FIG. 7 illustratively shows a musician 102 from a front view playing a clarinet 100 with an embodiment of the harness 200 engaged with the clarinet 100. In this embodiment, the harness 200 is connected to the clarinet 100 via a cuff 220 between the musicians' mouthpiece (not shown) and the instrument keys 110. Other embodiments contemplate the cuff 220, or other attachment device connecting to the clarinet 100 between the keys 110.

It is to be understood that even though numerous characteristics and advantages of various embodiments of the present invention have been set forth in the foregoing description, together with the details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. For example, optional links can be associated with the elongated rigid members 204 and 208 to fit different sized people while still maintaining substantially the same functionality without departing from the scope and spirit of the present invention. Another example can include different sized shoulder bends 206 and 210 for different sized people while still maintaining substantially the same functionality without departing from the scope and spirit of the present invention. Yet other examples can include optional shapes or constructions of the sternum plate 202, optional shapes of the elongated rigid members 204 and 208, and optional shapes and/or padding for the hook shaped shoulder bends 206 and 210, while still maintaining substantially the same functionality without departing from the scope and spirit of the present invention. Also, the terms "one" is synonymous with "a", which may be a first of a plurality.

It will be clear that the present invention is well adapted to attain the ends and advantages mentioned as well as those inherent therein. While presently preferred embodiments have been described for purposes of this disclosure, numerous changes may be made which readily suggest themselves to those skilled in the art and which are encompassed in the spirit of the invention disclosed and as defined in the appended claims.

What is claimed is:

1. A woodwind harness comprising:

a sternum plate adapted to contact a human sternum;

a first and second rigid member extending from the sternum plate each terminating in a hook shaped bend, each of the hook shaped bends adapted to hook over a human shoulder;

an elastic cord having a first and a second cord end, the first cord end attached to the first rigid member between the hook shaped end and the sternum plate, the second cord end attached to the second rigid member between the hook shaped end and the sternum plate; and a means for attaching an end-blown woodwind instrument to the elastic cord.

2. The woodwind harness of claim 1 wherein the hook shaped bends are adjustable by size and/or curvature.

3. The woodwind harness of claim 1 wherein the first and the second rigid members are adjustable in length.

4. The woodwind harness of claim 1 wherein the first and the second rigid members extend from the sternum plate at an angle of less than 90°.

5. The woodwind harness of claim 4 wherein rigid members can be adjusted at the sternum plate to change the angle.

6. The woodwind harness of claim 1 wherein the sternum plate only consists of the first and the second rigid member extending therefrom.

7. The woodwind harness of claim 1 further comprising a pair of pads each disposed at the distal location of the first and the second rigid members.

8. The woodwind harness of claim 7 wherein the pads are adapted to press against a human back and the sternum plate is adapted to press against the human sternum when worn by a human.

9. A woodwind harness comprising:

a first and second elongated arm extending from a center location at a first end, each of the elongated arms possessing a hook shaped bend at a second end, each of the hook shaped bends adapted to hook over a human shoulder;

an elastic cord having a first and a second cord end, each of the cord ends attached to one of the elongated arms between the center location and the hook shaped bends; and a means for attaching an end-blown woodwind instrument to the elastic cord.

10. The woodwind harness of claim 9 wherein the center location is a bend and the first elongated arm, the second elongated arm, and the bend are comprised of a unitary piece of material.

11. The woodwind harness of claim 9 wherein the center location is a sternum plate.

12. The woodwind harness of claim 11 wherein the only two elements that extend from the sternum plate are the first and the second elongated arms.

13. The woodwind harness of claim 9 wherein the hook shaped bends are adjustable in length and/or curvature.

14. The woodwind harness of claim 9 wherein the elastic cord is essentially comprised of rubber.

15. The woodwind harness of claim 9 wherein the means for attaching is a cuff adapted to wrap around the circumference of the end-blown woodwind instrument.

16. The woodwind harness of claim 15 wherein the cuff is attached to the woodwind instrument between a mouthpiece and keys of the end-blown woodwind instrument.

17. The woodwind harness of claim 9 wherein the elongated arms are adjustable.

18. The woodwind harness of claim 9 wherein the elastic cord is attached to the woodwind harness by way of spring retaining fixtures.

19. An end-blown woodwind harness comprising:

a sternum plate consisting of a first and a second elongated arm extending therefrom, the first elongated arm defining a first hook shaped bend and the second elongated arm defining a second hook shaped bend, the hook shaped bends adapted to hook over a human shoulder, the sternum plate adapted to press against a human chest;

an elastic cord having a first cord end and a second cord end, the first cord end attached to the first elongated arm between the sternum plate and the first hook shaped bend, the second cord end attached to the second elongated arm between the sternum plate and the second hook shaped bend; and a clip adapted to connect an end-blown woodwind instrument to the elastic cord.

* * * * *